US006058536A

United States Patent [19]

Henry

[11] Patent Number: 6,058,536

[45] Date of Patent: May 9, 2000

[54] CONTINUOUS CELL MATTRESS OVERLAY WITH FLOWABLE FILLER MATERIAL OF BUCKWHEAT HULLS

[76] Inventor: Lloyd W. Henry, 6709 Camelot Farms Rd., Radford, Va. 24141

[21] Appl. No.: 09/416,142

[22] Filed: Oct. 12, 1999

[51] Int. Cl.[7] ..... A47C 27/00

[52] U.S. Cl. ..... 5/691; 702/738; 702/951; 702/922

[58] Field of Search ..... 5/691, 738, 651, 5/702, 911, 655.4, 500, 502, 922

[56] References Cited

U.S. PATENT DOCUMENTS

| | | | |
|---|---|---|---|
| 1,335,965 | 4/1920 | Hoffmann | 5/738 |
| 3,459,179 | 8/1969 | Olesen | 5/655.4 |
| 4,163,297 | 8/1979 | Neumark . | |
| 4,193,152 | 3/1980 | Seibold, Jr. | 5/911 |
| 4,843,666 | 7/1989 | Elesh et al. . | |
| 4,862,538 | 9/1989 | Spann et al. . | |
| 5,103,517 | 4/1992 | Krouskop | 5/911 |
| 5,363,524 | 11/1994 | Lang | 5/640 |
| 5,713,089 | 2/1998 | Ferrante | 5/502 |
| 5,758,375 | 6/1998 | Horowitz | 5/951 |
| 5,970,541 | 10/1999 | Chiang | 5/502 |

FOREIGN PATENT DOCUMENTS

| | | | |
|---|---|---|---|
| 3524088A1 | 1/1986 | Germany | 5/691 |
| 3435261A1 | 4/1986 | Germany | 5/691 |

*Primary Examiner*—Alexander Grosz

[57] ABSTRACT

A mattress overlay consisting of two pieces of fabric joined along the longitudinal, or head to foot, edges and then joined transversely, from side to side, at predetermined distances along the longitudinal axis forming lateral, closed interior cell spaces. In the preferred embodiment, the joining method along at least one of the longitudinal edges uses openable and recloseable cooperating hook and loop pressure strips to allow access to the individual cells after manufacture. To provide even support throughout the resting area, the interior cell spaces are partially filled with a flowable filler material of Buckwheat hulls or a mixture of Buckwheat hulls and any other compatible material. The preferred embodiment allows resting comfort to be customized by adding or removing flowable filler from individual cell spaces as needed. The preferred embodiment has half of an openable and recloseable fastening device joined along longitudinal edge to allow attachment of two or more mattress overlays. The mattress overlay, when Buckwheat hulls are used as a filler material, resists the slippage of the human resting form when a bed is canted for medical purposes.

5 Claims, 2 Drawing Sheets

CONTINUOUS CELL MATTRESS OVERLAY WITH FLOWABLE FILLER MATERIAL OF BUCKWHEAT HULLS

BACKGROUND—FIELD OF INVENTION

This invention relates to mattress overlays, specifically to a mattress overlay with a more general application for providing even support over the entire resting human form.

BACKGROUND—DESCRIPTION OF PRIOR ART

Throughout history, human beings have sought a comfortable resting surface. Inventors have created many variations on the straw and feather mattresses of earliest times. Primary surfaces, mattresses, and secondary surfaces, overlays and pads, have evolved from natural products to man made foams and polyurethane. Medical problems, such as bedsores, have been addressed. Thereafter, inventors created resting devices such as cell mattresses, Buckwheat pillows, and polyurethane overlays, to solve specific resting problems for a selected part of the population.

Cell mattresses were originated primarily for the relief of bedsores for patients confined for long periods in bed—for example, U.S. Pat. No. 4,163,297 to Neumark (1979) and U.S. Pat. No. 4,843,666 to Elesh and Martelli. These pillow mattresses included a longitudinal support for the mattress, making them both bulky and not easily adaptable for use on existing beds. They do not employ continuous cell construction that is cheap and easily manufactured. These are full sized, fixed mattresses filled with materials that do not allow for natural air circulation. These pillow mattresses are not designed for mass marketing and the sleeping comfort of the general public.

A pillow using a flowable filler material such as Buckwheat hulls is covered in U.S. Pat. No. 5,363,524 to Lang (1994). This pillow is for comfort and support of the cervical area of the neck and head and is unsuitable in size and design for use as a mattress overlay. U.S. Pat. No. 4,862,538 to Spann, Schaefer and Krouskop (1989) for a polyurethane foam mattress overlay for systematized pressure dispersion is representative of the newer inventions in the field of mattress overlays. Again, the overlay's stated use is to give comfort to bedsore sufferers and is not suitable for general use by the public. The use of man made fillers reduces the circulation of air between overlay and user and necessarily creates a higher local warmth in body areas touching the overlay.

The above overlay and mattresses lack portability for those traveling or temporarily relocated.

The above prior art can be seen to have little value for use to the general public in providing a mattress overlay that is affordable, transportable, allows air circulation, and uses a majority of filler that is natural, non-toxic and environmentally safe on disposal.

SUMMARY

In accordance with the present invention a mattress overlay for humans comprising two pieces of fabric joined on longitudinal edges and transversely, side to side, forming lateral closed cells that are partially filled with a flowable filler material.

OBJECTS AND ADVANTAGES

Accordingly, besides the objects and advantages of the resting devices described in my above patent, several objects and advantages of the preferred embodiment of the present invention are:

(a) to provide, as a resting medium, a flowable filler material that allows air circulation, eliminating overheating of body contact points with unnatural foam fillers;

(b) to provide, as a resting medium, a flowable filler material that is a cheap natural material readily available to the buying public;

(c) to provide, as a resting medium, a flowable filler material with small enough particles to form a continually adjusting surface that molds to the contour of the resting human form;

(d) to provide, as a resting medium, a filler material that is a naturally renewable material that presents no threat to the environment on disposal;

(e) to provide lightweight continuous cell construction allowing economical manufacture while still providing that filler material will not spread too thin to provide continuous support;

(f) to provide a mattress overlay attaching system allowing one overlay to be attached to another;

(g) to provide a fabric joining that allows adjustment by the user of exactly the correct amount of flowable filler in each cell for resting comfort without dismantling the mattress overlay;

(h) to provide a mattress overlay that may be constructed in less than full bed size, allowing each side of a double bed full control over resting decisions;

(i) to provide a mattress overlay that is fully transportable by simply rolling it into a roll an average adult could carry under one arm;

(j) to provide a mattress overlay that spreads easily on a mattress and does not require fitted comers to retain its shape;

(k) to provide a mattress overlay which may be turned over for added wear.

Further objects and advantages are to provide a mattress overlay that resists slippage of the human body at rest on beds canted 4 degrees. This is the approximate angle recommended by physicians for sufferers of gastroesophageal reflux disease (GERD). It is estimated that 7 million Americans suffer from some form of GERD, see NIH Publication No.94-1447, May, 1994. One of the primary recommendations by physicians for aid in sleeping and resting comfort is to elevate the head of the bed 6 inches, resulting in a cant of approximately 4 degrees on a standard bed. At this angle the GERD sufferer's slippage, as well as that of a double bed sleeping partner, is a problem as the friction between overlay and mattress and human body and overlay is not sufficient to stop slippage as body movement occurs. The result is a constant feeling of climbing up the bed as the night progresses. Foam overlays and bed wedges are currently in use to stop such slippage. The solution using foam, as detailed above, creates hot areas for the sleeper where contact is made; the wedges do not allow comfortable sleeping on the side or stomach, the preferred sleep position of the majority of the public. In the preferred embodiment, the resting medium of the present invention is heavier than most other overlay materials and consists of thousands of individual material pieces that contour to the body and mattress shapes. These properties of my invention create greater friction and more vertical edges to resist the longitudinal forces causing slippage to the resting body. Still further objects and advantages will become apparent from a consideration of the ensuing description and drawings.

DRAWING FIGURES

Figure 1:
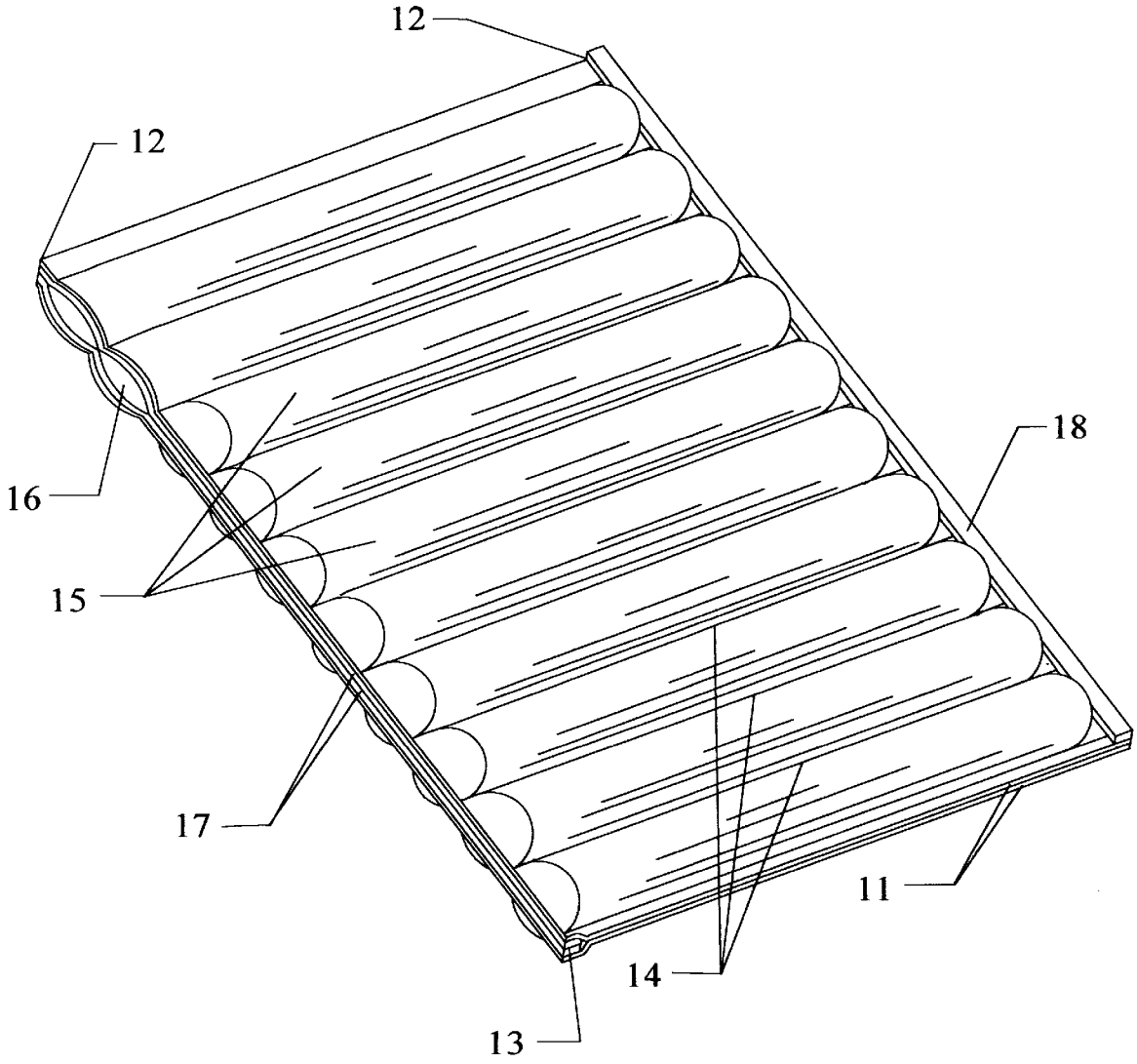
FIG. 1 shows an aspect of a completed continuous cell mattress overlay.

| Reference Numerals in Drawings | |
|---|---|
| 11 two pieces of fabric | 18 hook or loop pressure strip |
| 12 longitudinal edges | 19 adhesive material |
| 13 hook and loop pressure strips | 20 Sewing thread |
| 14 transverse fabric joinings | 21 partial seam |
| 15 continuous cells | 22 full seam |
| 16 open cell for filling with filler material | |
| 17 closed cells | |

DESCRIPTION

FIG. 1—Preferred Embodiment

The preferred embodiment of the present invention is illustrated in FIG. 1. It consists of two pieces of fabric 11 joined along one longitudinal (head to foot) edge 12. The opposite longitudinal edge 12 is joined with hook and loop pressure strips 13 (FIG. 2C) that are attached by thread 20 (FIG. 2B). The two pieces of fabric are then joined transversely in direct contact with each other, from side to side 14 on the remaining edges and at predetermined intervals along the longitudinal axis of the fabric, using thread 20. The resulting transverse interior spaces between the transverse joinings create continuous cells 15 between the two pieces of joined fabric. The open cells 16 are then partially filled with Buckwheat hulls. The cells are then closed 17 by applying pressure to the hook and loop pressure strips 13.

The preferred embodiment includes half of a pressure strip 18 (hook or loop) as shown along one of the joined longitudinal edges 12. In the preferred embodiment, attachment of this strip is by thread 20. This strip allows pressure attachment with another mattress overlay bearing the opposite type of pressure strip (loop or hook) 18.

Figure 2A:
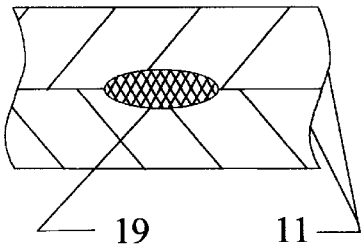
FIGS. 2A to 2C show various aspects of alternate fabric joining methods.
Figure 2B:
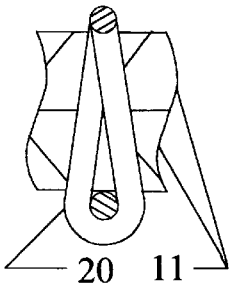
Figure 2C:
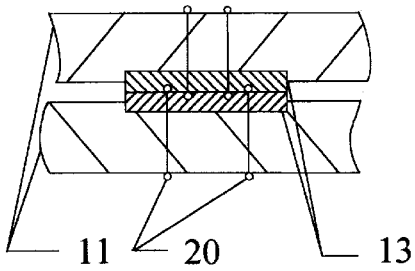

FIGS. 2A–C—Additional Embodiments

Additional embodiments are shown in FIGS. 2A–C for alternative methods of joining the fabric pieces 11 in FIG. 1. End views are presented across the axis of the joining. FIG. 2A shows joining by adhesive 19. FIG. 2B shows joining by thread 20. FIG. 2C shows joining by pressure strips (hook and loop) 13.

Figure 3A:
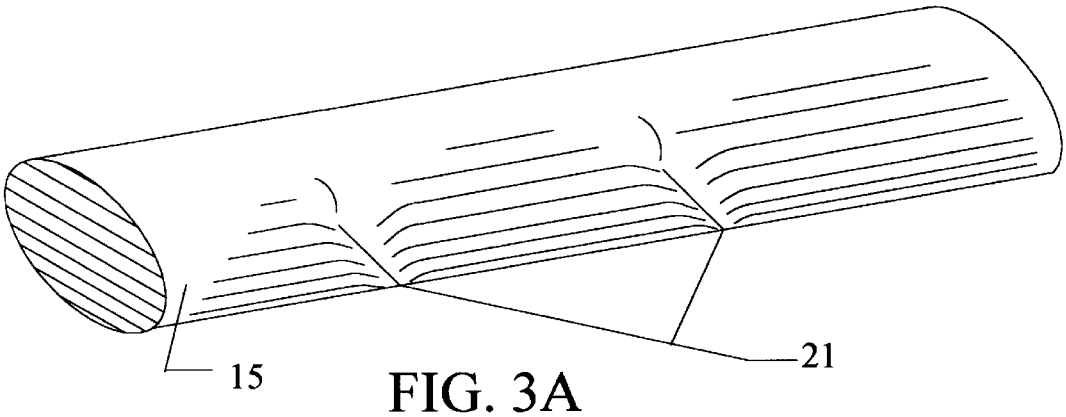
FIGS. 3A and 3B show two aspects of fabric joining to restrict flow of filler material.
Figure 3B:
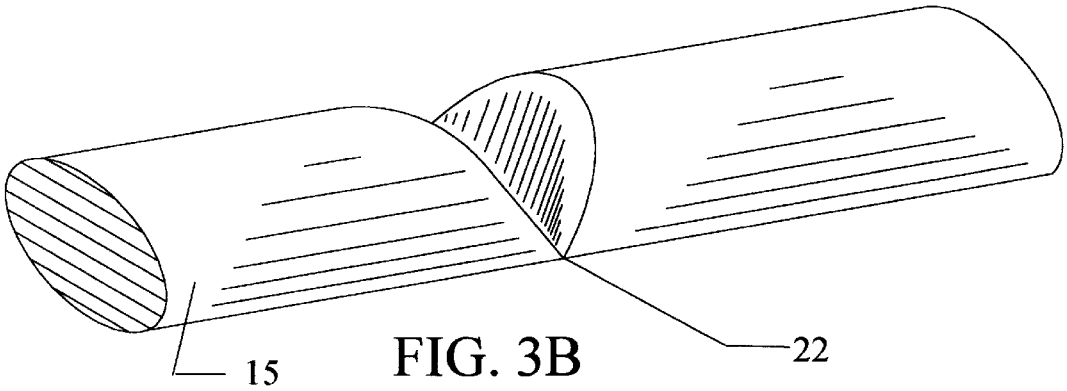

FIGS. 3A–3B—Additional Embodiments

The preferred embodiment of FIG. 1 does not restrict the flow of filler material within continuous cells 15. FIGS. 3A and 3B show two embodiments restricting flow of the filler material within the interior cell spaces. The embodiments shown use thread 20 to join fabric 11 to create a partial seam 21 and/or full seam 22 longitudinally across the cell 15. The other embodiments of FIGS. 2A and C may also be used to join fabric 11 to create scams 21 and 22.

Filler Material—Alternative Embodiment

An alternative embodiment of the a flowable filler material consists of a filler mixture of Buckwheat hulls and any other compatible material, where compatible material shall mean any material that does not materially detract from the characteristics of the Buckwheat hulls as enumerated in any other part of this patent.

Pressure Strip Attachment of Mattress Overlays—Alternative Embodiment

An alternative embodiment of attaching the mattress overlays by half of a pressure strip 18 consists of placing the half strip along any other edge of the mattress overlay of FIG. 1, allowing attachment of mattress overlays in a variety of ways.

Advantages

From the description above a number of advantages of my continuous cell mattress overlay with flowable filler material become evident:

a) The simplicity of design and construction make the overlay an economical, low cost alternative to overlays that are available to the general public.

b) The preferred embodiment use of all Buckwheat hulls for filler material uses a naturally renewable product that has found acceptance with the general public when used as a filler material for pillows.

c) The preferred embodiment method for closing one or more longitudinal edges allows the invention user to customize the mattress overlay to his or her comfort level by adding to or removing filler material from the overlay cells.

d) The mattress overlay stands alone without straps or pinning and is transportable by rolling up into a cylindrical shape.

e) The mattress overlay is identical on both sides allowing an extended wear life by simply flipping the mattress overlay over.

f) The length of the mattress overlay may be shortened by cutting off unwanted cells.

Operation—FIG. 1

The continuous cell mattress overlay is spread on the resting surface of the user's mattress. The overlay's length may be modified by cutting off any unwanted cells 15.

Flowable filler material may be added or removed to match body size, curvature, weight, and other characteristics (deformities, localized pain areas, etc.) to achieve the desired level of support by opening 16 hook and loop pressure strips 13. Applying pressure to hook and loop pressure strips 13 restores cell 15 to the closed 17, normal resting position.

To join two mattress overlays, pressure strip 18 (hook or loop) is aligned on one mattress overlay with opposite pressure strip 18 (loop or hook) on a second mattress overlay. Applying pressure to pressure strips 18 joins the two mattress overlays.

Conclusions, Ramifications, and Scope

Accordingly, the reader will see that the continuous cell mattress overlay with flowable filler material of this invention can be used as an unattached mattress overlay on any bed surface already existing, promoting healthful rest by providing even, constantly shifting support to the entire resting human body as it moves. The mattress overlay uses a preferred filler material that allows air to circulate within the support medium, that is naturally renewable, non-toxic, and has a favorable impact on the environment on disposal. Additionally, the mattress overlay is economical to manufacture due to its continuous cell structure, can be made in half bed sizes, allowing each side to be customized for user comfort, and is easily transportable. Further, the mattress overlay, in its preferred embodiment, allows addition or removal of cell filler for user comfort and resists user slippage on beds canted for medical purposes.

Although the description above contains many specifications, these should not be construed as limiting the scope of the invention but as merely providing illustrations of the presently preferred embodiments of this invention.

For example, the continuous cell mattress overlay can have other than a rectangular shape, such as circular, oval, etc. Also, the length may be shortened and the overlay turned ninety degrees allowing the cells to run longitudinally (head to foot) rather than transversely. Additionally, zipper, buttons, snaps or folds or any other method of attachment can accomplish fabric joining. Finally, the term mattress overlay as used in the title and body of this patent application does not limit a description of this invention in the more common terms of mattress pad or mattress pillow.

Thus the scope of the invention should be determined by the appended claims and their legal equivalents, rather than by the examples given.

What is claimed is:

1. A mattress overlay for humans comprising:

(a) two pieces of fabric, each having a head and foot portion, and two longitudinal edges, each of sufficient size to accommodate the average adult human being when at rest;

(b) means for joining said two pieces of fabric on the two longitudinal edges, head to foot, one of said means for joining comprising cooperating hook and loop pressure strips;

(c) means for joining said two pieces of fabric transversely, side to side, at predetermined distances over the longitudinal axis of said two pieces of fabric, forming lateral, closeable interior cell spaces;

(d) flowable filler means comprising Buckwheat hulls located within said interior cell spaces; and (e) longitudinal seam means across at least some of said cell spaces adapted to restrict the flow of said filler material within said cell spaces.

2. A mattress overlay for humans comprising:

(a) two pieces of fabric, each having a head and foot portion, and two longitudinal edges, each of sufficient size to accommodate the average adult human being when at rest;

(b) means for joining said two pieces of fabric on the two longitudinal edges, head to foot, one of said means for joining comprising cooperating hook and loop pressure strips;

(c) means for joining said two pieces of fabric transversely, side to side, in direct contact with each other, at predetermined distances over the longitudinal axis of said two pieces of fabric, forming lateral, closeable interior cell spaces; and (d) flowable filler means comprising Buckwheat hulls located within said interior cell spaces.

3. The mattress overlay of claim 2, further including means to join two or more overlays to each other.

4. The mattress overlay of claim 2, wherein the cooperating hook and loop pressure strips permit the customizing of the overlay by adding or removing filler means from the cell spaces, to match the curvature, weight, or other characteristics of a particular user of the overlay.

5. The mattress overlay of claim 2, wherein the filler means consist of Buckwheat hulls.

* * * * *